United States Patent [19]

Sugimoto et al.

[11] 4,431,731

[45] Feb. 14, 1984

[54] INTERNAL LATENT IMAGE SILVER HALIDE EMULSIONS

[75] Inventors: Tadao Sugimoto; Ichizo Toya; Shigeharu Urabe; Shinji Sakaguchi, all of Kanagawa, Japan

[73] Assignee: Fuji Photo Film Co., Ltd., Kanagawa, Japan

[21] Appl. No.: 349,550

[22] Filed: Feb. 17, 1982

[30] Foreign Application Priority Data

Feb. 19, 1981 [JP] Japan ..... 56-23521

[51] Int. Cl.[3] ..... G03C 1/34

[52] U.S. Cl. ..... 430/604; 430/599; 430/600; 430/603; 403/609; 430/605; 430/940; 430/409; 430/598

[58] Field of Search ..... 430/599, 600, 940, 609, 430/627, 630, 596, 598, 409, 410, 411, 603, 604, 605

[56] References Cited

U.S. PATENT DOCUMENTS

| | | | |
|---|---|---|---|
| 3,006,762 | 10/1961 | Dersch | 430/600 |
| 3,850,637 | 11/1974 | Evans | 430/409 |
| 4,294,920 | 10/1981 | Helling et al. | 430/609 |

FOREIGN PATENT DOCUMENTS

| | | | |
|---|---|---|---|
| 586916 | 11/1959 | Canada | 430/600 |
| 632762 | 12/1961 | Canada | 430/609 |
| 1585791 | 1/1970 | France | 430/411 |

*Primary Examiner*—Won H. Louie, Jr.
*Attorney, Agent, or Firm*—Sughrue, Mion, Zinn, Macpeak & Seas

[57] ABSTRACT

An internal latent image silver halide emulsion is disclosed comprising core/shell silver halide particles having a chemically sensitized surface which are composed of a core of silver halide doped with metal ions and/or subjected to chemical sensitization and a shell which covers said core as far as to do at least the sensitive sites of said core and a binder, wherein said silver halide emulsions contain a polymer containing a repeating unit represented by the following general formula (I) in an amount of 2 mg to 1000 mg per mole of silver as the weight of said repeating units in said polymer:

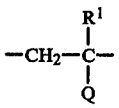

(I)

wherein $R^1$ represents a hydrogen atom or an alkyl group and Q represents a group selected from the group consisting of the following (1)–(4):

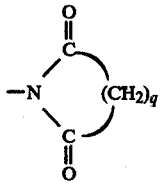

(1)

wherein q represents an integer of 2 to 4,

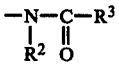

(2)

wherein $R^2$ and $R^3$ each represents a hydrogen atom or an alkyl group,

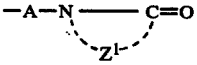

(3)

wherein $Z^1$ represents an atomic group necessary to complete a lactam ring, an oxazolidone ring or a pyridone ring, and A represents a single bond,

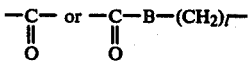

wherein B represents

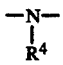

wherein $R^4$ represents a hydrogen atom or an alkyl group, and l represents an integer of 1 to 6, and

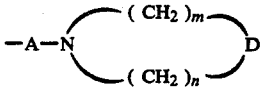

(4)

wherein A has the same meaning as in (3), D represents a single bond,

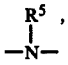

and m and n each represents an integer of 1 to 6 which satisfies the relationship m+n=4 to 7, wherein $R^5$ represents a hydrogen atom, an alkyl group or

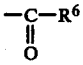

wherein $R^6$ represent an alkyl group.

The internal latent image silver halide emulsions have good stability with the passage of time.

9 Claims, No Drawings

INTERNAL LATENT IMAGE SILVER HALIDE EMULSIONS

FIELD OF THE INVENTION

The present invention relates to internal latent image silver halide emulsions which form direct positive photographic images, particularly, to internal latent image silver halide emulsions which undergo less changes in photographic properties under severe storage conditions such as high temperature and high humidity or high temperature and low humidity.

BACKGROUND OF THE INVENTION

As is described in U.S. Pat. Nos. 3,317,322 and 3,761,276, it is known that reversal images can be obtained by direct reversal processing comprising developing in the presence of a fogging agent or exposing the total element surface at development, when the surface of internal latent image silver halide particles, which comprises a core of silver halide which is doped with metal ions and/or subjected to chemical sensitization and shell of silver halide which covers at least the sensitive sites of said core (hereinafter, referred to as core/shell particles), are chemically sensitized.

However, chemically sensitized nuclei obtained by chemically sensitizing the surface of such internal latent image core/shell silver halide particles have the drawback that reversal photographic properties such as $D_{max}$ sensitivity or gradation, etc., deteriorate when they are stored for long periods of time or left in a severe environment such as at high temperature and high humidity, etc., because tney have poor stability with the passage of time.

SUMMARY OF THE INVENTION

An object of the present invention is to provide internal latent image silver halide emulsions having good stability with the passage of time which do not have the above described drawback.

The object of the present invention is attained by providing internal latent image silver halide emulsions comprising core/shell silver halide particles having a chemically sensitized surface which are composed of a core of silver halide doped with metal ions and/or subjected to chemical sensitization and a shell which covers said core as far as to do at least the sensitive sites of the core and a binder, wherein the silver halide emulsions contain a polymer containing a repeating unit represented by the following general formula (I) in an amount of 2 mg to 1000 mg per mol of silver as the weight of the repeating units in said polymer:

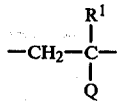

(I)

wherein $R^1$ represents a hydrogen atom or an alkyl group and Q represents a group selected from the class consisting of the following (1)-(4):

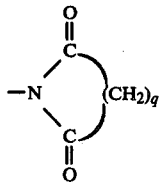

(1)

wherein q represents an integer of 2 to 4;

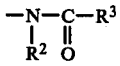

(2)

wherein $R^2$ and $R^3$ each represents a hydrogen atom or an alkyl group having 1 to 10 carbon atoms, and particularly 1 to 3 carbon atoms;

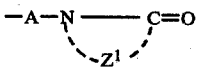

(3)

wherein $Z^1$ represents the atomic group necessary to complete a lactam ring, an oxazolidone ring or a pyridone ring, and A represents a single bond,

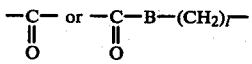

wherein B represents —O— or

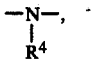

wherein $R^4$ represents a hydrogen atom or an alkyl group having 1 to 3 carbon atoms, and l represents an integer of 1 to 6; and

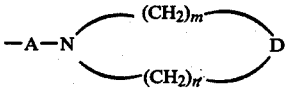

wherein A has the same meaning as in (3), D represents a single bond, —O— or

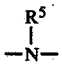

and m and n each represents an integer of 1 to 6 which satisfies the relationship m+n=4 to 7, wherein $R^5$ represents a hydrogen atom, an alkyl group having 1 to 3 carbon atoms or

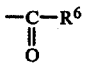

wherein $R^6$ represents an alkyl group having 1 to 3 carbon atoms.

DETAILED DESCRIPTION OF THE INVENTION

The core/shell silver halide particles of the emulsions of the present invention are obtained by preparing cores of silver halide doped with metal ions and/or subjected to chemical sensitization, covering the surface of said cores with a shell of silver halide, and chemically sensitizing the shell.

The whole surface of the cores is not necessarily covered with the shell, rather, it is sufficient to cover only the sensitive sites (parts where photolytic silver is formed by exposure to light) of the core.

In order to dope the cores with metal ions, one can use a process which comprises carrying out formation or physical ageing of the cores in the presence of a metal ion source such as a cadmium salt, zinc salt, lead salt, thallium salt or an indium salt or a complex salt thereof, a rhodium salt or a complex salt thereof, or an iron salt or a complex salt thereof, etc. The metal ions are used in an amount of $10^{-6}$ mols or more per mol of silver halide.

The silver halide of the cores may be subjected to chemical sensitization using one or more noble metal sensitizers, sulfur sensitizers and/or reducing sensitizers instead of or together with doping with the above described metal ions such an extent that the core/shell silver halide particles do not lose their internal latent image characteristics. Particularly, sensitivity increases greatly using gold sensitization in combination with sulfur sensitization.

Processes for treating cores of silver halide and processes for covering the surface of the silver halide particle of the core with silver halide to form a shell are known, and the processes described in, for example, U.S. Pat. Nos. 3,206,316, 3,317,322, 3,367,778 (excluding the step of fogging the surface of particles) and 3,761,276 can be advantageously utilized. These four patents are hereby incorporated by reference.

Although the ratio of silver halide in the core to silver halide in the shell is not limited, it is generally 2 to 8 mols of the shell to 1 mol of the core.

It is preferred that the silver halide in the core and in the shell have the same composition, but they may have each a different composition. In the present invention, silver bromide, silver iodide, silver chloride, silver chlorobromide, silver bromoiodide, silver chlorobromoiodide, etc., can be used as the silver halide. Preferred silver halide emulsions comprise at least 50 mol% of silver bromide, and most preferred emulsions are silver bromiodide emulsions which contain about 10 mol% or less of silver iodide.

In the present invention, core/shell silver halide particles having various particle sizes can be used. Good results are obtained with core/shell silver halide particles having an average particle size of about 0.1–4 microns, preferably, about 0.2–3 microns and, particularly about 0.2–1.5 microns.

The core/shell silver halide particles may have a regular crystal shape such as cubic or octahedral, an irregular crystal shape such as a spherical form or tabular form, may have a composite crystal form of such, or may be composed of a mixture of particles having various crystal shapes.

The surface of the core/shell silver halide particles prepared as described above is then chemically sensitized.

Chemical sensitization of the surface of core/shell silver halide particles is carried out by known methods as described in Glafkides; "Chimie et Physique Photographique" (published by Paul Montel, Co., 1967), V. L. Zelikman et al; "Making and Coating Photographic Emulsion" (published by The Focal Press Co., 1964) and H. Frieser; "Die Grundlagen der Photographischen Prozesse mit Silberhalogeniden" (Akademische Verlagsgesellshaft, 1968), etc., all hereby incorporated by reference.

Thus, sulfur sensitization using a sulfur containing compound capable of reacting with silver ion, reducing sensitization using a reductive substance and noble metal sensitization using a gold or other noble metals or compounds thereof can be used alone or as a combination thereof. Among these, a combination of gold sensitization and sulfur sensitization gives the best results, and, if desired or necessary, reducing sensitization may be used together with the above combination.

As sulfur sensitizers, thiosulfates, thioureas, thiazoles, rhodanines and other compounds can be used, examples of which are given in U.S. Pat. Nos. 1,574,944, 2,410,689, 2,278,947, 2,728,668 and 3,656,955.

As the reducing sensitizers, stannous salts, amines, hydrazine derivatives, formamidine sulfinic acid and silane compounds, etc. can be used, examples of which are given in U.S. Pat. Nos. 2,487,850, 2,419,974, 2,518,698, 2,983,609, 2,983,610 and 2,694,637.

In order to carry out noble metal sensitization, it is possible to use gold complex salts as well as complex salts of Group VIII metals in the periodic table such as platinum, iridium or palladium, etc., examples of which are given in U.S. Pat. Nos. 2,339,083 and 2,448,060 and British Pat. No. 618,061, etc.

All of the above patents are incorporated by reference.

Conditions of such chemical sensitization processes are selected in a manner conventional in the art. While good results are generally obtained at a pH of less than 9, a pAg of less than 10 and a temperature of more than 40° C., if desired or necessary, conditions beyond the above described ranges may be utilized.

The chemical sensitization of the surface of core/shell silver halide particles is carried out such an extent that the core/shell silver halide particles do not lose their internal latent image characteristics. In this specification "internal latent image characteristics" means that the maximum density measured by conventional photographic densitometry in the case that a silver halide emulsion applied to a transparent base is exposed to light for a fixed time of 0.01 to 10 seconds and developed thereafter with the following developing solution (A) (internal developing solution) at 20° C. for 3 minutes is at least 5 times larger than the maximum density obtained in the case that the silver halide emulsion is exposed to light in the same manner as described above and then developed with the following developing solution (B) (surface developing solution) at 20° C. for 4 minutes.

| Developing solution A: | |
|---|---|
| Hydroquinone | 15 g |
| Monomethyl-p-aminophenol sesquisulfate | 15 g |
| Sodium sulfite | 50 g |
| Potassium bromide | 10 g |
| Sodium hydroxide | 25 g |
| Sodium thiosulfate | 20 g |
| Water to make | 1 liter |

-continued

| Developing solution B: | |
|---|---|
| p-Oxyphenylglycine | 10 g |
| Sodium carbonate | 100 g |
| Water to make | 1 liter |

The core/shell silver halide particles of the present invention are dispersed in a binder by conventional methods.

As the binder, gelatin is advantageously used, but other hydrophilic colloids may also be used.

For example, it is possible to use proteins such as gelatin derivatives, graft polymers of gelatin with other high polymers, albumin or casein, etc., and sugar derivatives such as cellulose derivatives such as hydroxyethylcellulose, carboxymethylcellulose or cellulose esters, etc., sodium alginate or starch derivatives, etc.

As the gelatin, not only lime treated gelatin but also acid treated gelatin or enzyme treated gelatin as described in Bull. Soc. Sci. Photo. Japan, No. 16, page 30 (1966), hereby incorporated by reference, may be used. Further, hydrolyzed products and enzymatic decomposition products of gelatin can be used. As the gelatin derivatives, it is possible to use those which are obtained by reacting gelatin with various compounds such as acid halides, acid anhydrides, isocyanates, bromoacetic acid, alkane sultones, vinylsulfonamides, maleinimides, polyalkylene oxides or epoxy compounds, etc. Examples of them have been described in U.S. Pat. Nos. 2,614,928, 3,132,945, 3,186,846 and 3,312,553, British Pat. Nos. 861,414, 1,033,189 and 1,005,784 and Japanese Patent Publication No. 26845/67, all hereby incorporated by reference.

As the above described gelatin graft polymers, it is possible to use those which are obtained by grafting gelatin with a homo- or copolymer of a vinyl monomer such as acrylic acid, methacrylic acid, ester or amides thereof, acrylonitrile or styrene, etc. Particularly, graft polymers of gelatin with a polymer having a certain degree of compatibility with gelatin, for example, a polymer of acrylic acid, methacrylic acid, acrylamide, metharylamide or hydroxyalkyl methacrylate, etc. are preferred. Examples thereof are given in U.S. Pat. Nos. 2,763,625, 2,831,767 and 2,956,884, hereby incorporated by reference.

The internal latent image core/shell silver halide emulsions obtained as described above have drawback of deteriorating in photographic properties with the passage of time. Such a deterioration is remarkably prevented using the polymers of the present invention. The reason why such an effect is obtained is not clear, but it is believed that the effect is obtained because the polymers stabilize chemically sensitized nuclei at the surface of the core/shell silver halide particles, because the effect of improving stability with the passage of time is not obtained in internal latent image silver halide emulsions which have reversal characteristics but which are not or hardly subjected to chemical sensitization of the surface of silver halide particles (for example, those described in British Pat. Nos. 1,195,837 and 1,011,062, U.S. Pat. No. 2,592,250, and Japanese Patent Applications (OPI) No. 8524/75 and 38525/75), even if the polymers of the present invention are used.

The effect of the present invention is obtained when the polymer is added in an amount of 2 mg or more per mol of silver as the weight of the repeating units represented by general formula (I) included in the polymer.

It is known that some polymers (for example, polyvinylpyrrolidone) included in the polymers of the present invention can be used as a substitute for gelatin in internal latent image silver halide emulsions which have been or have not been subjected to surface chemical sensitization (British Pat. No. 1,195,837 and U.S. Pat. No. 3,761,276). These substitute polymers for gelatin are generally used to increase covering power (optical density of image and amount of silver per unit area composing the image). However, to our surprise, we found that if such polymers are used for internal latent image core/shell silver halide emulsions per the present invention which have been subjected to surface chemical sensitization, $D_{max}$ decreases and gradation softens to reduce reversal sensitivity when the amount of the polymers exceed a certain value. As a result of our experiment, it should be understood that the "certain value" is far less than the amount generally used for improving covering power.

Accordingly, in order to obtain the effect of improving stability with time per the present invention without causing a deterioration of $D_{max}$, a softening of gradation and a reduction of reversal sensitivity, the amount of the polymers used in the present invention should be far smaller than the amount used to improve covering power.

Accordingly, the amount of the polymer in the present invention is selected from a range of 2 mg to 1000 mg, particularly 2 mg to 400 mg per mol of silver, as the weight of repeating units represented by general formula (I) contained in the polymer, considering the kind of polymer to be used or the average particle size of core/shell silver halide to be used. Alternatively, the amount of the polymer in the present invention is selected from a range of $1\times10^{-2}$ mg to 6 mg, particularly $1\times10^{-2}$ mg to 2.5 mg per g of binder, as the weight of repeating units represented by general formula (I) contained in the polymer. Generally, the amount of the polymer becomes smaller as the average particle size of core/shell silver halide used increases, but it can be selected from the above described range as far as core/shell silver halide particles having a practical particle size are used.

The polymers used in the present invention contain the repeating unit represented by the general formula (I). Among them, preferred polymers are those wherein $R^1$ represents a hydrogen atom and Q represents any of (i)-(iii).

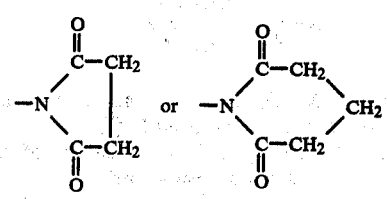

(i)

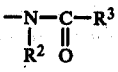

(ii)

wherein $R^2$ represents a methyl group or an ethyl group, and $R^3$ represents a hydrogen atom, a methyl group or an ethyl group.

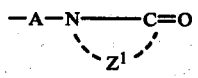

(iii)

wherein A represents a single bond or

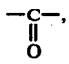

and $Z^1$ forms a 5-membered or 6-membered lactam ring or an oxazolidone ring.

Particularly preferred polymers are those wherein Q represents

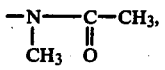

a pyrrolidone group or an oxazolidone group, particularly a pyrrolidone group.

Polymers containing the repeating unit represented by the general formula (I) include not only homopolymers but also copolymers.

Namely, they include polymers obtained by homopolymerization of monomers represented by the following general formula (IA)

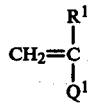

(IA)

wherein $Q^1$ represents any of the following (1)–(4):

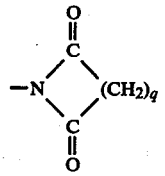

(1)

wherein q represents an integer of 2 to 4,

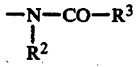

(2)

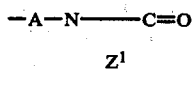

(3)

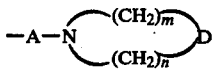

(4)

wherein $R_1$, $R_2$, $R_3$, A, $Z^1$, D, m, and n each has the same meaning as in general formula (I);

polymers obtained by copolymerization of two or more monomers described above; and polymers obtained by copolymerization of the above described monomer and one or more ethylenically unsaturated compounds capable of addition polymerization.

Examples of the monomers represented by general formula (IA) include N-vinylsuccinimide, N-vinylglutarimide, N-vinyladipamide, N-vinylacetamide, N-methyl-N-vinylformamide, N-methyl-N-vinylacetamide, N-ethyl-N-vinylacetamide, N-methyl-N-vinylpropionamide, N-vinylpyrrolidone, N-vinylpiperidone, N-vinyl-ε-caprolactam, N-vinyloxazolidone, N-acryloylpyrrolidone, N-acryloyloxyethylpyrrolidone, N-acryloylmorpholine, N-acryloypiperidine, N-methacryloylmorpholine, N-β-morpholinoethylacrylamide, N-vinylmorpholine and N-vinyl-2-pyridone, etc.

Among these, preferred examples include N-vinylsuccinimide, N-vinylglutarimide, N-methyl-N-vinylacetamide, N-ethyl-N-vinylacetamide, N-vinylpyrrolidone, N-vinylpiperidone and N-vinyloxazolidone.

Particularly preferred examples include N-methyl-N-vinylacetamide, N-vinylpyrrolidone and N-vinyloxazolidone.

As addition-polymerizable ethylenically unsaturated compounds capable of producing copolymers with monomers represented by the general formula (IA), there are acrylic acids, methacrylic acids, maleic anhydrides, acrylic acid esters, methacrylic acid esters, acrylamides, methacrylamides, allyl compounds, vinyl ethers, vinyl esters, vinyl heterocyclic compounds, styrenes, maleic acid esters, fumaric acid esters, itaconic acid esters, crotonic acid esters and olefins, etc., each having 2 to 20 carbon atoms, which do not exert a harmful influence on a photographic characteristic.

Examples thereof include methyl acrylate, ethyl acrylate, isopropyl acrylate, n-butyl acrylate, octyl acrylate, 2-chloroethyl acrylate, 2-cyanoethyl acrylate, N-(β-dimethylaminoethyl)acrylate, benzyl acrylate, cyclohexyl acrylate, phenyl acrylate, methyl methacrylate, n-propyl methacrylate, isopropyl methacrylate, n-butyl methacrylate, cyclohexyl methacrylate, 3-sulfopropyl methacrylate, allyl butyl ether, allyl phenyl ether, methyl vinyl ether, butyl vinyl ether, methoxyethyl vinyl ether, 2-hydroxyethyl vinyl ether, (2-dimethylaminoethyl)vinyl ether, vinyl phenyl ether, vinyl chlorophenyl ether, acrylamide, methacrylamide, N-methyl acrylamide, N-(1,1-dimethyl-3-oxobutyl)acrylamide, N-(1,1-dimethyl-3-hydroxybutyl)acrylamide, N,N-dimethyl acrylamide, acryloylhydrazine, N-methoxymethyl methacrylamide, N-(1,1-dimethyl-3-hydroxybutyl)methacrylamide, N-hydroxymethyl acrylamide, vinylpyridine, N-vinylimidazole, N-vinylcarbazole, vinylthiophene, styrene, chloromethylstyrene, p-acetoxystyrene, p-methylstyrene, p-vinylbenzoic acid, methyl p-vinylbenzoate, crotonamide, butyl crotonate, glycerine monocrotonate, methyl vinyl ketone, phenyl vinyl ketone, ethylene, propylene, 1-butene, dicyclopentadiene, 4-methyl-1-hexene, 4,4-dimethyl-1-pentene, methyl itaconate, ethyl itaconate, diethyl itaconate, methyl sorbate, ethyl maleate, butyl maleate, dibutyl maleate, octyl maleate, ethyl fumarate, dibutyl fumarate, octylfumarate, halogenated olefins such as vinyl chloride, vinylidene chloride, isoprene, etc. and unsaturated nitriles such as acrylonitrile or methacrylonitrile, etc., as disclosed in "Kagaku Daijiten", p. 619, published by Kyoritsu Shuppan Co. (1976). Two or more thereof may be used if desired.

Examples of preferred monomers from the viewpoint of the hydrophilic properties of the polymer produced include acrylic acid, methacrylic acid, 2-hydroxyethyl acrylate, 2-methoxyethyl acrylate, sulfopropyl acrylate, acrylamide, dimethylacrylamide, 2-acryloylamino-2-methylpropanesulfonic acid, hydroxyethyl acrylamide, methacrylamide, methyl vinyl ether, sodium styrenesulfonate, N-vinyl-3,5-dimethyltriazole, maleic acid anhydride, etc.

Although the composition of copolymers containing the repeating unit represented by the general formula (I) is not particularly restricted, it is preferred that the component(s) represented by general formula (I) be present in a ratio of 10—less than 100 mol%, particularly, 50—less than 100 mol%.

Such polymers and copolymers containing repeating units represented by general formula (I) can be synthesized by processes as described in British Pat. No. 1,211,039, Japanese Patent Publication No. 29195/72, Japanese Patent Applications (OPI) Nos. 76593/73, 92022/73, 21134/74 and 120634/74, British Pat. No. 961,395, U.S. Pat. Nos. 3,227,672, 3,290,417, 3,262,919, 3,245,932, 2,681,897 and 3,230,275, "Official Digest" by John C. Petropoulos et al, vol. 33, pages 719–736 (1961) and "Gosei Kobunshi", edited by Toshisuke Murahashi et al, vol. 1, pages 246–290, and vol. 3, pages 1–108, etc., all incorporated by reference. Of course, the polymerization initiator, concentration, polymerization temperature and reaction time can be easily and broadly varied using conventional procedures.

For example, polymerization is generally carried out at 20°–180° C., preferably, 40°–120° C., using a radical polymerization initiator in an amount of 0.05–5% by weight based on monomers to be polymerized. As the initiator, there are azobis compounds, peroxides, hydroperoxides and redox catalysts, etc., for example, potassium persulfate, tert-butyl peroctate, benzoylperoxide, azobisisobutyronitrile, 2,2'-azobiscyanovaleric acid and 2,2'-azobis(2-amidinopropane)hydrochloride, etc.

The molecular weight of the polymers used in the present invention is generally about 2000 or more. The molecular weight refers to a viscosity-average molecular weight.

Examples of typical polymers containing the repeating unit represented by general formula (I) used in the present invention include the following.

(1) Poly-(N-vinylpyrrolidone)
(2) Poly-(N-vinyloxazolidone)
(3) Poly-(N-vinylsuccinimide)
(4) Poly-(N-vinylglutarimide)
(5) Poly-(N-vinylpiperidone)
(6) Poly-(N-vinyl-ε-caprolactam)
(7) Poly-(N-methyl-N-vinylacetamide)
(8) Poly-(N-ethyl-N-vinylacetamide)
(9) Poly-(N-vinylacetamide)
(10) Vinyl alcohol-N-vinyl acetamide copolymer (molar ratio: 30:70)
(11) Vinyl alcohol-N-vinylpyrrolidone copolymer (molar ratio: 20:80)
(12) Vinyl alcohol-N-vinylpyrrolidone copolymer (molar ratio: 30:70)
(13) N-vinylpyrrolidone-vinyl acetate copolymer (molar ratio: 70:30)
(14) N-vinylpyrrolidone-2-hydroxyethylacrylate copolymer (molar ratio: 70:30)
(15) N-vinylpyrrolidone-acrylic acid copolymer (molar ratio: 90:10)
(16) N-vinylpyrrolidone-N-vinyl-3,5-dimethyltriazole copolymer (molar ratio: 50:50)
(17) N-vinylpiperidone-2-methoxyethyl acrylate copolymer (molar ratio: 70:30)
(18) N-vinylpiperidone-methyl vinyl ether copolymer (molar ratio: 90:10)
(19) N-vinyloxazolidone-vinyl alcohol copolymer (molar ratio: 65:35)
(20) N-vinyloxazolidone-acrylic acid copolymer (molar ratio: 80:20)
(21) N-vinylpyrrolidone-N-vinylpiperidone-2-hydroxyethyl acrylate copolymer (molar ratio: 40:30:30)
(22) Vinyl alcohol-vinyl acetate-N-vinyl-2-pyridone copolymer (molar ratio: 70:25:5)
(23) N-vinylpyrrolidone-2-hydroxyethyl acrylate-vinyl acetate copolymer (molar ratio: 70:20:10)
(24) N-vinylpyrrolidone-vinyl alcohol-vinyl propionatesodium styrenesulfonate copolymer (molar ratio: 40:40:5:15)
(25) N-vinylpyrrolidone-acrylamide copolymer (molar ratio: 60:40)
(26) N-vinylpyrrolidone-2-acrylamide-2-methylpropanesulfonic acid copolymer (molar ratio: 75:25)
(27) N-vinylpiperidone-acrylamide copolymer (molar ratio: 60:40)
(28) N-vinyloxazolidone-N-(2-hydroxyethyl)arcylamide copolymer (molar ratio: 70:30)
(29) N-vinylpyrrolidone-N-vinylmorpholine-acrylamide copolymer (molar ratio: 50:20:30)
(30) N-vinylsuccinimide-N-vinyl-ε-caprolactam-acrylamide copolymer (molar ratio: 40:20:40)
(31) N-vinyloxazolidone-acrylamide-acrylic acid copolymer (molar ratio: 60:20:20)
(32) N-vinylpyrrolidone-acrylamide-vinyl acetate-acrylic acid copolymer (molar ratio: 60:20:10:10)
(33) N-vinylpyrrolidone-dimethylacrylamide copolymer (molar ratio: 70:30)

The time of adding the above described polymers to the internal latent image silver halide emulsions of the present invention is not particularly restricted, but the polymers are generally added after conclusion of chemical sensitization of the surface of the core/shell silver halide particles.

The internal latent image silver halide photographic emulsions of the present invention may be spectrally sensitized with methine dyes and others in a conventional manner. Dyes used include cyanine dyes, merocyanine dyes, complex cyanine dyes, complex merocyanine dyes, holopolar cyanine dyes, hemicyanine dyes, styryl dyes and hemioxonol dyes. Particularly useful dyes are cyanine dyes, merocyanine dyes and complex merocyanine dyes. In these dyes, any nucleus generally utilized in cyanine dyes can be utilized. Namely, it is possible to utilize a pyrroline nucleus, an oxazoline nucleus, a thiazoline nucleus, a pyrole nucleus, an oxazole nucleus, a thiazole nucleus, a selenazole nucleus, an imidazole nucleus, a tetrazole nucleus and a pyridine nucleus, etc., nuclei which are formed by fusing alicyclic hydrocarbon rings to the above described nuclei, and nuclei which are formed by fusing aromatic hydrocarbon rings to the above described nuclei, namely, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus, etc. These nuclei may have substitutes on carbon atoms of the nuclei.

In merocyanine dyes and complex merocyanine dyes, it is possible to utilize 5 to 6 membered heterocyclic nuclei such as a pyrazolin-5-one nucleus, a thiohydantoin nucleus, a 2-thioxazolidin-2,4-dione nucleus, a thiazolidin-2,4-dione nucleus, a rhodanine nucleus or a thiobarbituric acid nucleus, etc., as the nuclei having a ketomethylene structure.

Useful sensitizing dyes are include those described in, for example, German Pat. No. 929,080, U.S. Pat. Nos. 2,231,658, 2,493,748, 2,503,776, 2,519,001, 2,912,329, 3,655,394, 3,656,959, 3,672,897 and 3,694,217, British Pat. No. 1,242,588 and Japanese Patent Publication No. 14030/69, all incorporated by reference.

Although these sensitizing dyes can be used alone, combinations thereof may also be used. Combinations of sensitizing dyes are often used for the purpose of supersensitization. Useful examples include those described in U.S. Pat. Nos. 2,688,545, 2,977,229, 3,397,060, 3,522,052, 3,527,641, 3,617,293, 3,628,964, 3,666,480, 3,679,428, 3,703,377, 3,769,301, 3,814,609 and 3,837,862, British Pat. No. 1,344,281 and Japanese Patent Publication No. 4936/68, etc., all incorporated by reference.

The emulsions may contain dyes having no spectral sensitization function or substances which do not substantially absorb visible rays but illustrate a supersensitization function together with the sensitizing dyes. For example, they may contain aminostilbene compounds substituted by nitrogen containing heterocyclic groups (for example, those described in U.S. Pat. No. 2,933,390), aromatic acid-formaldehyde condensation products (for example, those described in U.S. Pat. No. 3,743,510), cadmium salts and azaindene compounds, etc. The combinations described in U.S. Pat. Nos. 3,615,613, 3,615,641, 3,617,295 and 3,635,721 are particularly useful. All those patents are incorporated by reference.

Although the internal latent image silver halide emulsions of the present invention contain the above described polymer, spectral sensitization by the above described sensitizing dyes is not obstructed because the amount of the polymer is small.

In the case of producing sensitive materials using the internal latent image silver halide photographic emulsions of the present invention, the emulsion of the present invention is applied to a base together with, if desired or necessary, other photographic layers. The amount of application is not restricted, but good reversal images can be obtained in the case of applying the emulsion to a silver content of about 40 mg to 800 mg per square foot of the base.

In the following discussion to Example 1, all patents or publications are expressly incorporated by reference unless specifically indicated to the contrary.

As the base, those described in Product Licensing Index, vol. 92, page 108 "Supports" can be used.

The internal latent image silver halide photographic emulsions of the present invention may contain, for example, polyalkylene oxide or derivatives thereof such as ethers, esters or amines thereof, thioether compounds, thiomorpholines, quaternary ammonium compounds, urethane derivatives, urea derivatives, imidazole derivatives and 3-pyrazolidones, etc., for the purpose of increasing sensitivity, increasing contrast or accelerating development. For example, it is possible to use the substances described in U.S. Pat. Nos. 2,400,532, 2,423,549, 2,716,062, 3,617,280, 3,772,021 and 3,808,003, etc.

The internal latent image silver halide photographic emulsions of the present invention may contain antifoggants or stabilizers. As such compounds, those described in Product Licensing Index: vol. 92, page 107, "Antifoggants and Stabilizers" can be used.

The internal latent image silver halide photographic emulsions of the present invention may contain developing agents. As such developing agents, those described in Product Licensing Index: vol. 92, pages 107–108, "Developing Agents" can be used.

The internal latent image silver halide photographic emulsions of the present invention can be dispersed in colloids capable of being hardened by various organic and inorganic hardening agents. As hardening agents, those described in Product Licensing Index: vol. 92, page 108, "Hardeners" can be used.

The internal latent image silver halide photographic emulsions of the present invention may contain coating aids. As the coating aids, those described in Product Licensing Index: vol. 92, page 108, "Coating Aids" can be used.

The internal latent image silver halide photographic emulsions of the present invention may contain color couplers. As the color couplers, those described in Products Licensing Index: vol. 92, page 110, "Color Materials" can be used.

Further, the internal latent image silver halide photographic emulsions of the present invention may contain antistatic agents, plasticizers, matting agents, lubricants, ultraviolet absorbers, fluorescent whitening agents, air antifoggants, etc.

In the sensitive materials produced using the internal latent image silver halide photographic emulsions of the present invention, photographic emulsion layers and other hydrophilic colloid layers may contain dyes as filter dyes or for preventing irradiation or for other purposes. As such dyes, those described in Product Licensing Index: vol. 92, page 109, "Absorbing and Filter Dyes" can be used.

The internal latent image silver halide photographic emulsions of the present invention are developed in the presence of a fogging agent (nucleating agent) or developed while exposing the total face thereof, whereby reversal images are formed.

Typical examples of fogging agents capable of use in the present invention include hydrazines as described in U.S. Pat. Nos. 2,588,982 and 2,563,785, hydrazides and hydrazones as described in U.S. Pat. No. 3,227,552, quaternary salt compounds as described in British Pat. No. 1,283,835, Japanese Patent Publication No. 38164/74 and U.S. Pat. Nos. 3,615,615, 3,719,494, 3,734,738, 4,094,683 and 4,115,122, etc., sensitizing dyes having a nucleating substituent in the dye molecule as described in U.S. Pat. No. 3,718,470, and acylhydrazinophenylthiourea compounds as described in U.S. Pat. Nos. 4,030,925 and 4,031,127. In addition, compounds as described in U.S. Pat. No. 4,139,387 and Japanese Patent Applications (OPI) Nos. 133126/79 and 74729/79 can be used.

It is preferred that the fogging agent be used in such an amount that sufficient maximum density is obtained when the internal latent image silver halide emulsion of the present invention is developed with a surface developing solution such as hereinbefore described Developer B. The fogging agent is preferably added to the photographic layer or layer adjacent thereto.

The internal latent image silver halide photographic emulsions of the present invention can be put to various uses. Particularly, they can be advantageously used as emulsions for direct positive sensitive materials, emulsions for multilayer reversal color sensitive materials or emulsions for use in a multilayer color diffusion transfer process.

The photographic emulsions of the present invention can be used for obtaining desired transfer images on an image receiving layer after a suitable development processing by combination with a diffusion transfer color image forming substance which releases a diffusible dye corresponding to development of silver halide. As such diffusion transfer color image forming substances, numbers of substances have been known. For example, it is possible to use the compounds as described in U.S. Pat. Nos. 3,227,551, 3,227,554, 3,443,939, 3,443,940, 3,658,524, 3,698,897, 3,725,062, 3,728,113, 3,751,406, 3,929,760, 3,931,144, 3,932,381, 3,928,312, 4,013,633, 3,932,380, 3,954,476, 3,942,987, 4,013,635, and 4,268,625, U.S. patent Defensive Publication No. 351,673, British Pat. Nos. 840,731, 904,364 and 1,038,331, German Patent Applications (OLS) Nos. 1,930,215, 2,214,381, 2,228,361, 2,317,134 and 2,402,900, French Pat. No. 2,284,140, Japanese Patent Applications (OPI) Nos. 113524/76 (corresponding to U.S. Pat. No. 4,055,428), 104343/76 and 143323/78, and it is particularly preferred to use color image forming substances which are not diffusible in the initial state but release a diffusible dye by an oxidation-reduction reaction with an oxidation product of the developing agent (hereinafter referred to as DRR compound).

Particularly preferred compounds capable of use together with the photographic emulsion of the present invention include DRR compounds having an o-hydroxyarylsulfamoyl group as described in the above described Japanese Patent Application (OPI) No. 113624/76 and DRR compounds having a redox nucleus as described in Japanese Patent Application No. 64533/77. If such DRR compounds are used together, processing temperature dependence is low.

Examples of useful DRR compounds include, in addition to those described in the above described patents, 1-hydroxy-2-tetramethylenesulfamoyl-4-(3'-methyl-4'-(2''-hydroxy-4''-methyl-5''-hexadecyloxyphenylsulfamoyl)phenyl azo)naphthalene as a magenta dye image forming substance and 1-phenyl-3-cyano-4-(3'-(2''-hydroxy-4''-methyl-5''-(2''',4'''-di-t-pentylphenoxyacetamino)phenylsulfamoyl)phenylazo)5-pyrazolone as a yellow dye image forming substance.

In order to develop the sensitive materials of the present invention, various known developing agents can be used. Namely, it is possible to use polyhydroxybenzenes, for example, hydroquinone, 2-chlorohydroquinone, 2-methylhydroquinone, catechol and pyrogallol, etc., aminophenols, for example, p-aminophenol, N-methyl-p-aminophenol and 2,4-diaminophenol, etc., 3-pyrazolidones, for example, 1-phenyl-3-pyrazolidones, 4,4-dimethyl-1-phenyl-3-pyrazolidone and 5,5-dimethyl-1-phenyl-3-pyrazolidone, etc., ascorbic acids, etc., which are used alone or in combination. Further, in the case of obtaining dye images in a presence of dye forming couplers, it is possible to use aromatic primary amino developing agents, preferably p-phenylenediamine developing agents. Examples of developing agents include 4-amino-3-methyl-N,N-diethylaniline hydrochloride, N,N-diethyl-p-phenylenediamine, 3-methyl-4-amino-N-ethyl-N-$\beta$-(methane-sulfonamide)ethylaniline, 3-methyl-4-amino-N-ethyl-N-($\beta$-sulfoethyl)aniline, 3-ethoxy-4-amino-N-ethyl-N-($\beta$-sulfoethyl)aniline and 4-amino-N-ethyl-N-($\beta$-hydroxyethyl)aniline. These developing agents may be incorporated in an alkaline processing composition (processing element) or may be incorporated in a suitable layer such as emulsion layer or other hydrophilic colloidal layer of the sensitive element.

In case of using DRR compounds in the present invention, any silver halide developing agent can be used if it is able to cross-oxidize with the DRR compounds.

The developing solution may also contain sodium sulfite, potassium sulfite, ascorbic acid, and reductones (for example, piperidinohexose reductone), etc., as a preservative.

Using the sensitive materials of the present invention, direct positive images can be obtained by developing with a surface developing solution. Development by the surface developing solution is substantially induced by latent images of fogging nuclei on the surface of silver halide particles. It is preferred that silver halide solvents not be present in the developing solution. However, the developing solution may contain a small amount of silver halide solvent (for example a thiosulfate) as long as any internal latent image present does not substantially contribute to image formation until the development by a surface developing center of silver halide particles is substantially completed.

The developing solution may contain sodium hydroxide, potassium hydroxide, sodium carbonate, potassium carbonate, sodium tertiary phosphate and sodium metaborate, etc., as alkali agents or buffer agents. The amount of these agents is best selected so that the pH of the developing solution is 10–13 and, preferably, 11–12.5.

The developing solution may contain color development accelerators such as benzyl alcohol, etc. Further, it is advantageous to further reduce the minimum density of the direct positive images, that the developing solution contain compounds which are conventionally used as antifoggants, such as benzimidazoles, for example, 5-nitrobenzimidazole, or benzotriazoles, for example, benzotriazole and 5-methylbenzotriazole, etc.

The sensitive materials of the present invention can also be processed with a viscous developing solution, if desired.

This viscous developing solution is a liquid composition containing processing components necessary to develop the silver halide emulsion and to form diffusion transfer dye images, where the solvent comprises water as a major component and may contain hydrophilic solvents such as methanol or methyl cellosolve. The processing composition contains alkali in an amount sufficient to keep the pH at a value necessary to cause development of the emulsion layer and to neutralize acids formed during development and dye image formation (for example, hydrohalogenic acids such as hydrobromic acid, etc., and carboxylic acids such as acetic acid, etc.). As the alkalis, it is possible to use alkali metal salts, alkaline earth metal salts and amines, such as lithium hydroxide, sodium hydroxide, potassium hydroxide, calcium hydroxide dispersion, tetramethyl ammonium hydroxide, sodium carbonate, sodium tertiary phosphate or diethylamine, etc., and it is preferred to use caustic alkalis in an amount necessary to make the pH about 12 or more, particularly 14 or more, at room temperature. It is more preferred that the processing composition contain hydrophilic polymers such as polyvinyl alcohol having a high molecular weight, hydroxyethyl cellulose or sodium carboxymethyl cellulose. These polymers are advantageously used in such an amount that the viscosity of the processing composition is more than 1 poise at a room temperature and, preferably, several hundred poises (500–600) to 1000 poises.

It is advantageous, particularly, in the case of a monosheet film unit, that light absorbing substances such as TiO, carbon black or pH indicator dyes, etc., or desensitizers as described in U.S. Pat. No. 3,579,333 be added to the processing composition to prevent fogging of the silver halide emulsion by external light during or after the processing. Furthermore, it is possible to add restrainers such as benzotriazole to the processing composition.

It is preferred that the above described composition be used by putting the same in a breakable container, as described in U.S. Pat. Nos. 2,543,181, 2,643,886, 2,653,732, 2,723,051, 3,056,491, 3,056,492 and 3,142,515, etc.

In the case of using the sensitive materials of the present invention for a diffusion transfer process, the sensitive materials are preferred to have the form of a film unit. The photographic film unit, namely, a film unit which is processed by passage through a pair of juxtaposed pressing members, is basically composed of the following three elements:

(1) A photosensitive element containing a fogging agent, (2) An image receiving element, and (3) A processing element; which includes means for releasing an alkaline processing composition in the interior of the film unit, for example, a breakable container, and contains a silver halide developing agent.

A preferred embodiment of a photographic film unit is one which is unified in a body by lamination, such as described in Belgium Pat. No. 757,959. In this embodiment, an image receiving layer, a substantially opaque light-reflective layer (for example, a $TiO_2$ layer and a carbon black layer) and a photosensitive element comprising one or more silver halide sensitive layers combined with a DRR compound(s) are applied to a transparent base in this order, and a transparent cover sheet is put thereon so as to be in a face-to-face relation. The breakable container containing an alkaline processing composition containing an opaque agent (for example, carbon black) is arranged so as to be adjacent the top layer of the above described sensitive layers and the transparent cover sheet. When this film unit is exposed to light through the transparent cover sheet and taken out of the camera, the container is broken by the pressing members whereby the processing composition (containing the opaque agent) is spread all over the space between the protective layer on the sensitive layers and the cover sheet. Thus, the film unit is shielded from light and development proceeds. It is preferred that the cover sheet be prepared by applying a neutralization layer and, if desired or necessary, a neutralization rate controlling layer (timing layer) to the base in this order.

Further, other useful embodiments of monosheet type film unit are described in U.S. Pat. Nos. 3,415,644, 3,415,645, 3,415,646, 3,647,487 and 3,635,707 and German Patent Application (OLS) No. 2,426,980, etc.

In the following, examples of the present invention are described. However, the present invention is not limited thereto.

EXAMPLE 1

A silver bromide emulsion was obtained by simultaneous mixing of a solution of silver nitrate and a solution of potassium bromide in equimolar amounts at 50° C. for 20 minutes by a conventional controlled double jet process. After conclusion of precipitation, cubic crystals having an average length of 0.1μ were formed. To the resultant silver bromide, 40 mg of sodium thiosulfate per mol of silver and 40 mg of chloroauric acid (tetrahydrate) per mol of silver were added, and chemical sensitization was carried out by heating at 75° C. for 60 minutes.

Using the resultant silver bromide particles as cores, octahedral core/shell particles having an average side length of 0.25μ were obtained by growing crystals by adding a solution of silver nitrate and a solution of potassium bromide by a conventional simultaneous mixing method to the cores. Surface sensitization was carried out by adding 3.4 mg of sodium thiosulfate per mol of silver and 3.4 mg of chloroauric acid (tetrahydrate) per mol of silver and heating at 60° C. for 60 minutes to prepare an internal latent image direct positive emulsion (Emulsion I). Emulsion I contains about 170 g of gelatin per mol of silver.

To Emulsion I, the fogging agent: 1-formyl-2-{4-(3-phenylureido)phenyl}hydrazine was added in an amount of 800 mg per mol of silver and Polymer (1) (an average molecular weight: about 10,000) of the present invention was added in the amounts as described in Table 1. These emulsions were applied to a polyethylene terephthalate base to provide a silver content of 3000 mg/m, and a conventional gelatin protective layer was applied to the resultant layer to produce Samples 1-9.

After these samples were allowed to stand at a temperature of 60° C. and a relative humidity of 10% for 2 days, they were exposed to light at a color temperature of 2854° K. from a 1 KW tungsten lamp for 1 second through a step wedge and then developed at 35° C. for 1 minute using Developing Solution C as shown in Table 2. Thereafter, stopping, fixing and washing were carried out in a conventional manner.

On the other hand, a second set of Samples 1-9 were preserved at room temperature (25° C.) and at a relative humidity of 50%, exposed to light under the same conditions as above and developed, etc., with the same developing solution, etc., as above described.

In Table 1, $D_{max}$, reversal sensitivity and the gradation of each sample before the passage of time, and relative change, as percent, $((D-D_o/D_o)$ wherein D is $D_{max}$ of the incubated sample and $D_o$ is $D_{max}$ of the sample preserved at a room temperature and 50% RH are given.

TABLE 1

| Sample | Amount of Polymer (1) | Fresh $D_{max}$ | Fresh S* | Fresh γ | Relative Change by the Lapse of Time $((D - D_o)/D_o) \times 100$ |
|---|---|---|---|---|---|
| 1 | 0 mg/Ag 1 mol | 2.30 | 0.73 | 1.90 | −37% |
| 2 | 34 mg/Ag 1 mol | 2.52 | 0.76 | 1.98 | −15% |
| 3 | 68 mg/Ag 1 mol | 2.65 | 0.77 | 1.98 | −7% |
| 4 | 136 mg/Ag 1 mol | 2.65 | 0.78 | 1.95 | 0% |
| 5 | 204 mg/Ag 1 mol | 2.63 | 0.80 | 1.95 | 0% |
| 6 | 272 mg/Ag 1 mol | 2.45 | 0.82 | 1.88 | 0% |
| 7 | 340 mg/Ag 1 mol | 2.10 | 0.90 | 1.88 | 0% |
| 8 | 680 mg/Ag 1 mol | 1.68 | 0.92 | 1.46 | 0% |
| 9 | 1360 mg/Ag 1 mol | 0.96 | 0.93 | 1.08 | 0% |

*Sensitivity is the value: log E giving the density of $(D_{max} - D_{min})/2$.)

TABLE 2

| Developing Solution C | |
|---|---|
| Sodium sulfite | 50 g |
| Potassium carbonate | 40 g |
| Sodium bromide | 5 g |
| Pyrazone | 2 g |
| Hydroquinone | 22 g |
| 5-Methylbenzotriazole | 20 mg |

TABLE 2-continued

| Developing Solution C | |
|---|---|
| Water to make | 1 liter |
| pH controlled with potassium hydroxide | 11.6 |

As will be obvious from Table 1, deterioration of $D_{max}$ with time at high temperature and low humidity is remarkably prevented by the addition of the polymer of the present invention.

EXAMPLE 2

For purpose of comparison, cubic silver chlorobromide particles having an average side length of 0.5μ composed of AgBr 45 mol% and AgCl 55 mol% were produced by simultaneously mixing a solution of silver nitrate and an equimolar amount of a solution sodium chloride and potassium bromide at 70° C. for 100 minutes, and a solution of a mixture of potassium bromide and potassium iodide was added within 1 minute thereto to produce an internal latent image emulsion having the final molar ratio of AgBr:AgCl:AgI 70:29:1 (Emulsion II) by a conventional halogen exchange process.

To the resultant emulsion, the fogging agent: 1-formyl-2-[4-{3-(2-methoxyphenyl)ureido}phenyl]hydrazine was added in an amount of 600 mg per mol of silver and Polymer (1) (an average molecular weight: about 10,000) was added in the amount given in Table 3. These emulsions were applied to a polyethylene terephthalate base in the same manner as in Example 1 to provide a silver content of 3000 mg/m², and a conventional gelatin protective layer was applied to the resultant layer to produce Samples 10–13.

On the other hand, as samples of the present invention, Samples 14–16, were produced by adding 600 mg of the fogging agent: 1-formyl-2-[4-{3-(2-methoxyphenyl)ureido}phenyl]hydrazine per mol of silver to Emulsion I, adding Polymer (1) (an average molecular weight: about 10,000) as shown in Table 3, and applying the resultant emulsions in the same manner as used to form Samples 12–15.

The results obtained under the same condition as in Example 1 are shown in Table 3.

TABLE 3

| Sample | Emulsion | Amount of Polymer (1) | $(D-D_o)/D_o \times 100$ |
|---|---|---|---|
| 10 | II | 0 mg/Ag 1 mol | −5% |
| 11 | II | 34 mg/Ag 1 mol | −27% |
| 12 | II | 68 mg/Ag 1 mol | −35% |
| 13 | II | 136 mg/Ag 1 mol | −36% |
| 14 | I | 0 mg/Ag 1 mol | −47% |
| 15 | I | 34 mg/Ag 1 mol | −16% |
| 16 | I | 136 mg/Ag 1 mol | 0% |

As will be obvious from Table 3, in internal latent image emulsion (II) prepared by the halogen exchange process which was not subject to chemical sensitization of the surface of particles, deterioration of $D_{max}$ with the passage of time at high temperature and low humidity was accelerated by Polymer (1) and the effect of preventing deterioration of $D_{max}$ was not observed. On the contrary, with core/shell emulsion (I) which was subjected to surface chemical sensitization, a remarkable effect of improving stability with time was observed.

EXAMPLE 3

To emulsion (I) described in Example 1, the fogging agent: 1-formyl-2-[4-{3-(2-methoxyphenyl)ureido}-phenyl]hydrazine was added in an amount of 600 mg per mol of silver and the polymers as described in Table 4 were each added in an amount of 50 mg per mol of silver. These emulsions were applied to a polyethylene terephthalate base to a silver content of 300 mg/m², and a conventional gelatin protective layer was applied to the resultant layer to produce Samples 17–23.

These samples were divided into two lots: One being allowed to stand at a temperature of 60° C. and a relative humidity of 10% for 2 days and a second being allowed to stand at a temperature of 50° C. and a relative humidity of 80% for 2 days.

After the above time, they were exposed to light at a color temperature of 2854° K. from a 1 kW tungsten lamp for 1 second through a step wedge and then developed at 35° C. for 1 minute using Developing Solution C shown in Table 2.

A third set of Samples 17–23 was preserved at room temperature (25° C.) and a relative humidity of 50% for two days and then exposed to light, developed and fixed by the conventional manner as per the above described elapsed samples. The relative change $(D-D_o)/D_o$ is shown as a percent in Table 4, wherein $D_o$ is $D_{max}$ in the case of the preserved samples and D is $D_{max}$ in the case of the elapsed samples which were allowed to stand under the above described compulsory conditions.

TABLE 4

| Sample | Polymer | $(D-D_o)/D_o \times 100$ 60° C., 10% RH for 2 days | 50° C., 80% RH for 2 days |
|---|---|---|---|
| 17 | None | −35% | −61% |
| 18 | Polymer (1) (An average molecular weight: About 10,000) | −10% | −25% |
| 19 | Polymer (2) (An average molecular weight: About 20,000) | −24% | −30% |
| 20 | Polymer (6) (An average molecular weight: About 40,000) | −21% | −30% |
| 21 | Polymer (11) (An average molecular weight: About 120,000) | −12% | −19% |
| 22 | Polymer (13) (An average molecular weight: About 100,000) | −7% | −12% |
| 23 | Polymer (14) (An average molecular weight: About 200,000) | −24% | −24% |

While the invention has been described in detail and with reference to specific embodiment thereof, it will be apparent to one skilled in the art that various changes and modifications can be made therein without departing from the spirit and scope thereof.

What is claimed is:

1. In an internal latent image silver halide emulsion comprising core/shell silver halide particles having a chemically sensitized surface and which are composed of a core of silver halide doped with metal ions and/or subjected to chemical sensitization and a shell which covers at least the sensitive sites of said core and a binder, the improvement wherein said silver halide emulsion contains a homopolymer containing a repeating unit represented by the formula (I) or a copolymer selected from the group consisting of copolymers obtained by copolymerization of only monomers of the formula (I) or copolymers obtained by copolymerization of a monomer of the formula (I) and an addition-polymerizable ethylenically unsaturated compound, said homopolymer or copolymer being present in a stabilizing amount of 2 mg to 1,000 mg per mole of silver in the case of said homopolymer or being present in a stabilizing amount providing 2 mg to 1,000 mg of the repeating unit of the formula (I) per mole of silver in the case of said copolymer,

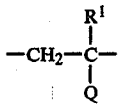

(I)

wherein $R^1$ represents a hydrogen atom and Q represents a group selected from the gorup consisting of the following (1)-(4):

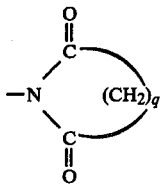

(1)

wherein q represents an integer of 2 to 4,

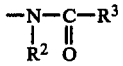

(2)

wherein $R^2$ and $R^3$ each represents a hydrogen atom or an alkyl group,

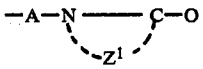

(3)

wherein $Z^1$ represents an atomic group necessary to complete a lactam ring, an oxazolidone ring or a pyridone ring, and A represents a single bond,

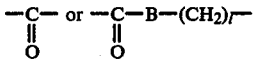

wherein B represents —O— or

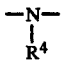

wherein $R^4$ represents a hydrogen atom or an alkyl group, and l represents an integer of 1 to 6,
and

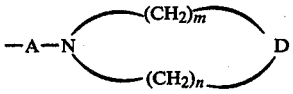

wherein A has the same meaning as in (3), D represents a single bond, —O— or

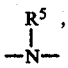

and m and n each represents an integer of 1 to 6 which satisfies the relationship m+n=4 to 7, wherein $R^5$ represents a hydrogen atom, an alkyl group or

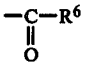

wherein $R^6$ represents an alkyl group.

2. The internal latent image silver halide emulsion as in claim 1, wherein Q represents a group selected from the group consisting of the following (i)-(iii):

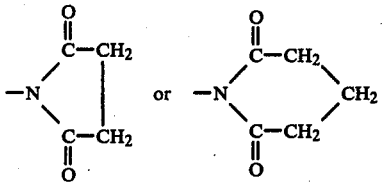

(i)

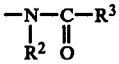

(ii)

wherein $R^2$ represents a methyl group or an ethyl group, and $R^3$ represents a hydrogen atom, a methyl group or an ethyl group

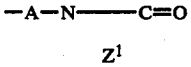

(iii)

wherein A represents a single bond or

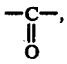

and $Z^1$ forms a 5-membered or 6-membered lactam ring or an oxazolidone ring.

3. The internal latent image silver halide emulsion as in claim 2, wherein Q represents

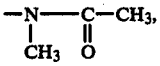

a pyrrolidone group or a oxazolidone group.

4. The internal latent image silver halide emulsion as in claim 3, wherein Q represents a pyrrolidone group.

5. Internal latent image silver halide emulsion as in claim 1 wherein said silver halide emulsion contains said homopolymer.

6. The internal latent image silver halide emulsion as in claim 1, wherein said polymer is a copolymer which is obtained by copolymerization of the following general formula (IA):

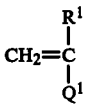

(IA)

wherein $R^1$ represents a hydrogen atom or an alkyl group and Q represents a group selected from the group consisting of the following (1)-(4):

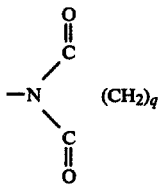

(1)

wherein q represents an integer of 2 to 4,

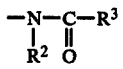

(2)

wherein $R^2$ and $R^3$ each represents a hydrogen atom or an alkyl group,

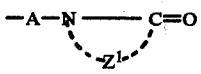

(3)

wherein $Z^1$ represents an atomic group necessary to complete a lactam ring, an oxazolidone ring or a pyridone ring, and A represents a single bond,

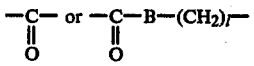

wherein B represents —O— or

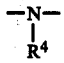

wherein $R^4$ represents a hydrogen atom or an alkyl group, and l represents an integer of 1 to 6,
and

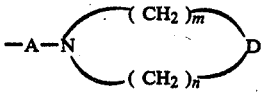

(4)

wherein A has the same meaning as in (3), D represents a single bond, —O— or

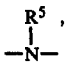

and m and n each represents an integer of 1 to 6 which satisfies the relationship m+n=4 to 7, wherein $R^5$ represents a hydrogen atom, an alkyl group or

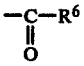

wherein $R^6$ represents an alkyl group, and one or more ethylenically unsaturated compounds capable of addition polymerization.

7. The internal latent image silver halide emulsion as in claim 1, wherein said homopolymer or copolymer has a molecular weight of about 2000 or more.

8. The internal latent image silver halide emulsion as in claim 1, wherein said homopolymer or copolymer is selected from a group consisting of poly-(N-vinylpyrrolidone), poly-(N-vinyloxazolidone), poly-(N-vinylsuccinimide), poly-(N-vinylglutarimide), poly-(N-vinylpiperidone), poly-(N-vinyl-ε-caprolactam), poly-(N-methyl-N-vinylacetamide), poly-(N-ethyl-N-vinylacetamide), poly-(N-vinylacetamide), vinyl alcohol-N-vinyl acetamide copolymer (molar ratio: 30:70), vinyl alcohol-N-vinylpyrrolidone copolymer (molar ratio: 20:80), vinyl alcohol-N-vinylpyrrolidone copolymer (molar ratio: 30:70), N-vinylpyrrolidone-vinyl acetate copolymer (molar ratio: 70:30), N-vinylpyrrolidone-2-hydroxyethylacrylate copolymer (molar ratio: 70:30), N-vinylpyrrolidone-acrylic acid copolymer (molar ratio: 90:10), N-vinylpyrrolidone-N-vinyl-3,5-dimethyltriazole copolymer (molar ratio: 50:50), N-vinylpiperidone-2-methoxyethyl acrylate copolymer (molar ratio: 70:30), N-vinylpiperidone-methyl vinyl ether copolymer (molar ratio: 90:10), N-vinyloxazolidone-vinyl alcohol copolymer (molar ratio: 65:35), N-vinyloxazolidone-acrylic acid copolymer (molar ratio: 80:20), N-vinylpyrrolidone-N-vinylpiperidone-2-hydroxyethyl acrylate copolymer (molar ratio: 40:30:30), vinyl alcohol-vinyl acetate-N-vinyl-2-pyridone copolymer (molar ratio: 70:25:5), N-vinylpyrrolidone-2-hydroxyethyl acrylate-vinyl acetate copolymer (molar ratio: 70:20:10), N-vinylpyrrolidone-vinyl alcohol-vinyl propionatesodium styrenesulfonate copolymer (molar ratio: 40:40:5:15), N-vinylpyrrolidone-acrylamide copolymer (molar ratio: 60:40), N-vinylpyrrolidone-2-acrylamide-2-methylpropane-sulfonic acid copolymer (molar ratio: 75:25), N-vinylpiperidoneacrylamide copolymer (molar ratio: 60:40), N-vinyloxazolidone-N-(2-hydroxyethyl)acrylamide copolymer (molar ratio: 70:30), N-vinylpyrrolidone-N-vinylmorpholine-acrylamide copolymer (molar ratio: 50:20:30), N-vinylsuccinimide-N-vinyl-ε-caprolactam-acrylamide copolymer (molar ratio: 40:20:40), N-vinyloxazolidone-acrylamide-acrylic acid copolymer (molar ratio: 60:20:20), N-vinylpyrrolidone-acrylamide-vinyl acetate-acrylic acid copolymer (molar ratio: 60:20:10:10), and N-vinylpyrrolidone-dimethylacrylamide copolymer (molar ratio: 70:30).

9. The internal latent image silver halide emulsion as in claim 1 wherein said stabilizing amount is 2 mg to 400 mg per mole of silver.

* * * * *